US008596592B2

(12) United States Patent
Li et al.

(10) Patent No.: US 8,596,592 B2
(45) Date of Patent: Dec. 3, 2013

(54) SPRAY GUN ADJUSTING DEVICE

(75) Inventors: Man-Cang Li, Shenzhen (CN); Feng-Yuen Dai, New Taipei (TW); Yung-Ta Lo, New Taipei (TW)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 121 days.

(21) Appl. No.: 13/307,211

(22) Filed: Nov. 30, 2011

(65) Prior Publication Data

US 2012/0273632 A1 Nov. 1, 2012

(30) Foreign Application Priority Data

Apr. 29, 2011 (CN) ..... 2011 1 0110005

(51) Int. Cl.
*A47F 5/00* (2006.01)

(52) U.S. Cl.
USPC ..... 248/125.8; 248/125.9; 248/274.1

(58) Field of Classification Search
USPC ..... 248/125.8, 125.9, 127, 688, 646, 676, 248/157, 422, 419, 420, 176.1, 205.1, 248/274.1, 287.1, 292.12, 309.1; 118/313, 118/323, 300; 427/421.1; 239/225.1, 264; 124/56
See application file for complete search history.

(56) References Cited

U.S. PATENT DOCUMENTS

2007/0042123 A1* 2/2007 Endregaard et al. ..... 427/421.1
2009/0007844 A1* 1/2009 Krogedal et al. ..... 118/313

* cited by examiner

*Primary Examiner* — Todd M. Epps
(74) *Attorney, Agent, or Firm* — Altis & Wispro Law Group, Inc.

(57) ABSTRACT

A spray gun adjusting device for adjusting painting position of spray gun includes a first axis mechanism and a second axis mechanism slidably positioned on first axis mechanism. First axis mechanism includes a screw rod extending along first direction, a first sliding block, a screw nut sleeved on the screw rod, a first bevel gear fixed to screw nut, a second bevel gear meshing with first bevel gear, and a first driving shaft fixedly connected to second bevel gear, and the screw nut and first driving shaft are rotatably positioned on first sliding block. Second axis mechanism includes a sliding rod along second direction, a second sliding block slidably sleeved on sliding rod, a gear rack fixed to sliding rod, a gear meshing with gear rack, and a second driving shaft fixed to the gear, and second sliding block is fixed to first sliding block of first axis mechanism.

19 Claims, 11 Drawing Sheets

SPRAY GUN ADJUSTING DEVICE

BACKGROUND

1. Technical Field

The present disclosure relates generally to adjusting devices for adjusting a painting position of a spray gun and, particularly, to a spray gun adjusting device using the adjusting device.

2. Description of Related Art

Using a plurality of spray guns for painting is a widespread practice because of its higher productivity and higher utilization rate of paint. The positions and angles of the spray guns are adjustable for realizing a multi-angle painting to satisfy the coating requirements of various products. Many conventional spray gun adjusting devices are, for example, gun racks which are utilized to adjust and maintain an optimum painting position.

Presently, there are two kinds of gun racks utilized in painting technology, one is a simple hand-operated gun rack, and the other is an automated gun rack. The simple hand-operated gun rack utilizes a plurality of locking screws. However, during painting, because the spray guns are frequently switched on/off, the screws may become loosen due to the impact of pneumatic elements of the spray guns, and the positions of the spray guns may be shifted, resulting in poor painting stability. In addition, the painting operation has to be shut down during the position adjusting of the spray gun rack, and this reduces productivity.

The automated gun rack normally has three degrees of freedom, which limits the adjustment angles of the spray guns. In addition, a plurality of motors may be utilized in the automated gun rack, which are often non-explosion-proof, and the automated gun rack is mounted in a spraying area, where the automated gun rack may easily be contaminated by organic solvents and become a fire risk, or may even explode.

Therefore, there is room for improvement within the art.

BRIEF DESCRIPTION OF THE DRAWINGS

The components in the drawings are not necessarily drawn to scale, the emphasis instead placed upon clearly illustrating the principles of the present disclosure. Moreover, in the drawings, like reference numerals designate corresponding parts throughout the several views.

DETAILED DESCRIPTION

Figure 1:
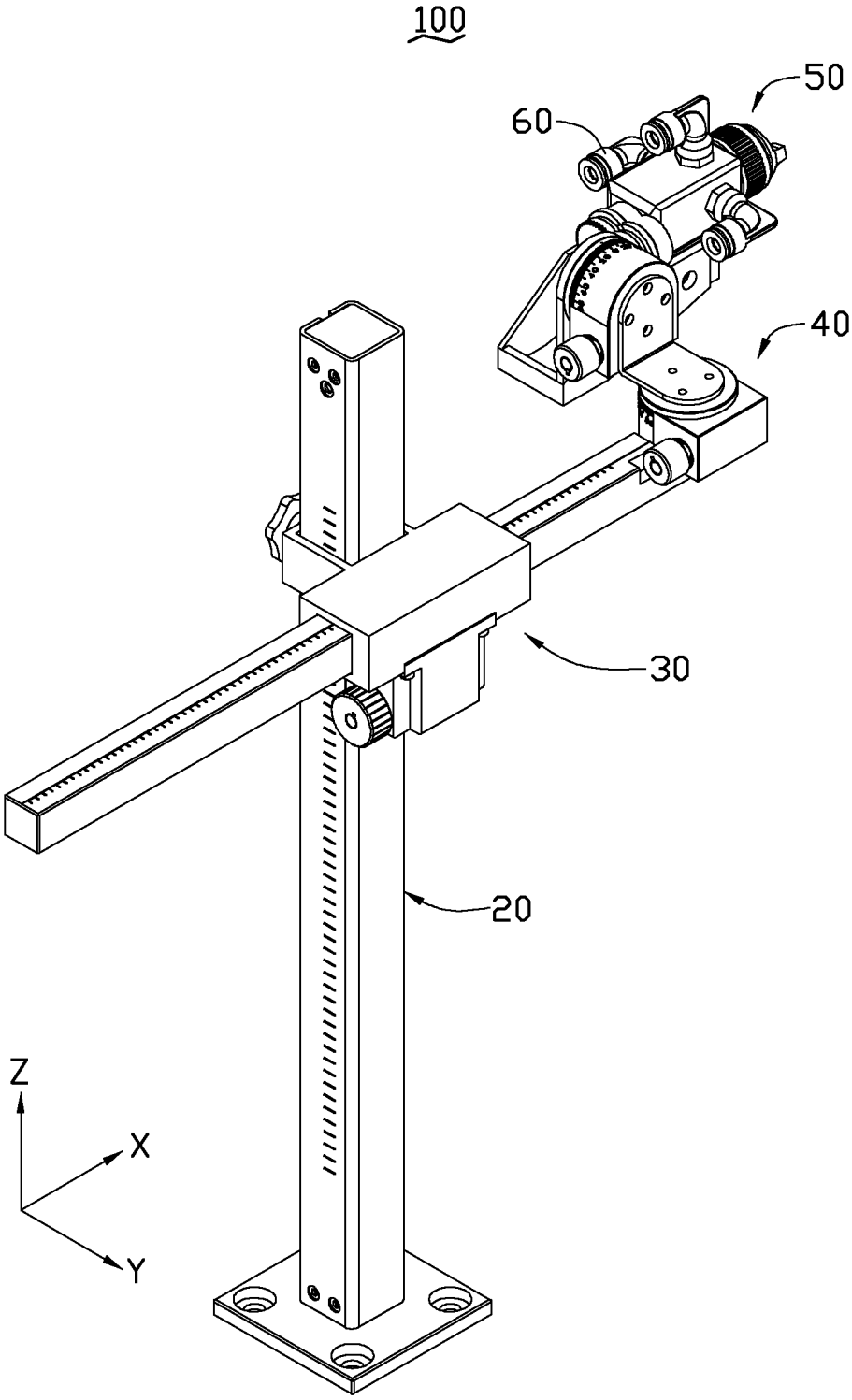
FIG. 1 is an isometric view of one embodiment of a spray gun adjusting device to support a plurality of spray guns, the spray gun adjusting device including a first axis mechanism, a second axis mechanism, a third axis mechanism, and a fourth axis mechanism.

Referring to FIG. 1, one embodiment of a spray gun adjusting device 100 utilized to adjust and maintain an optimum painting position for a plurality of spray guns 60 is shown. The spray gun adjusting device 100 includes a first axis mechanism 20, a second axis mechanism 30 slidably positioned on the first axis mechanism 20, a third axis mechanism 40 rotatably positioned on the second axis mechanism 30, and a fourth axis mechanism 50 rotatably connected to the third axis mechanism 40. The first axis mechanism 20 can drive the spray guns 60 in a first direction (the Z-axis direction shown in the FIG. 1), the second axis mechanism 30 can drive the spray guns 60 in a second direction (the X-axis direction shown in the FIG. 1), the third axis mechanism 40 can drive the spray guns 60 to rotate around the first direction, and the fourth axis mechanism 50 can drive the spray guns to rotate around the third direction (the Y-axis direction shown in the FIG. 1).

Figure 2:
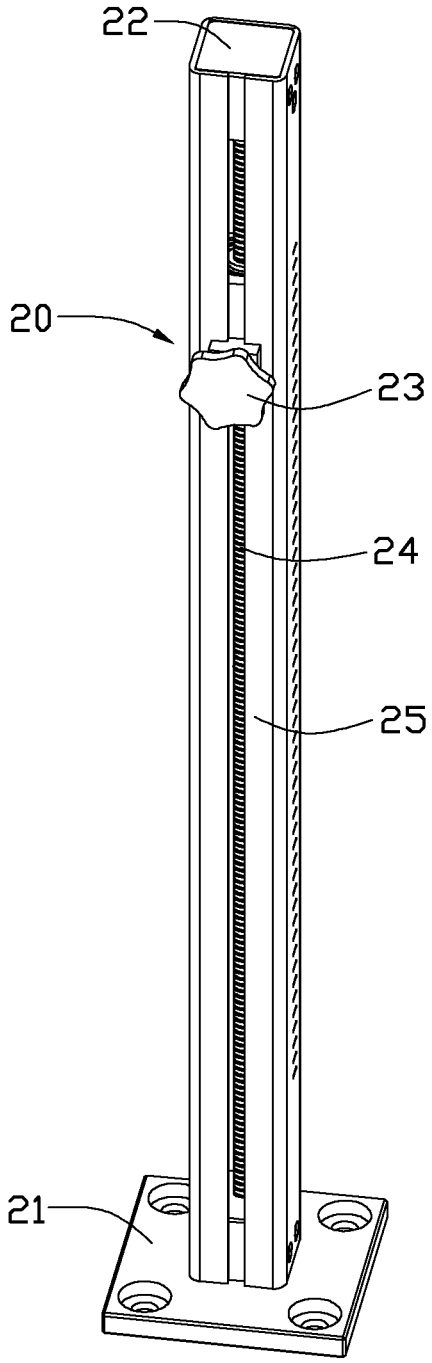
FIG. 2 is an isometric view of the first axis mechanism of the spray gun adjusting device of FIG. 1, the first axis mechanism including a first adjusting module.
Figure 3:
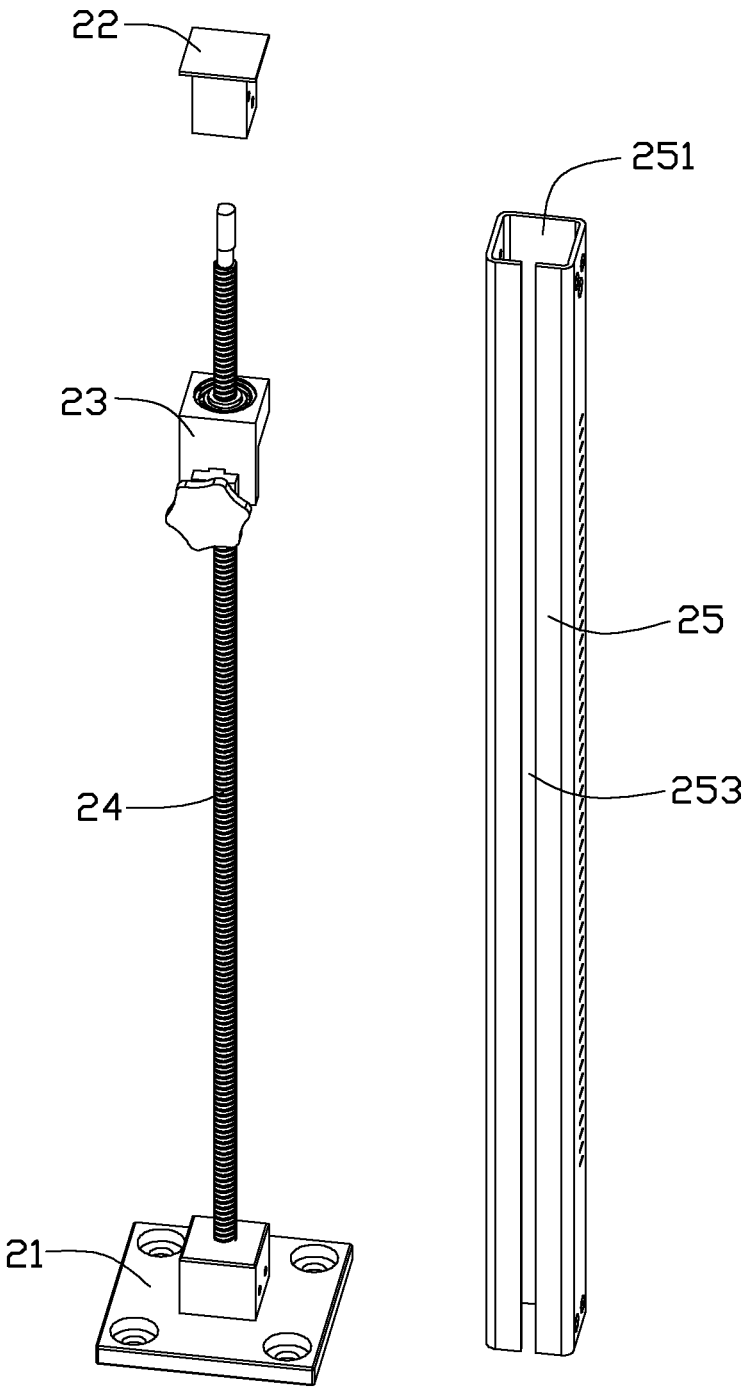
FIG. 3 is an exploded, isometric view of the first axis mechanism of FIG. 2.

Referring to FIGS. 2 and 3, the first axis mechanism 20 includes a base 21, a cover 22, a first adjusting module 23, a screw rod 24, and a shaft sleeve 25. The screw rod 24 is fixed on the base 21, and the cover 22 is disposed on the screw rod 24. The first adjusting module 23 is slidably sleeved on the screw rod 24. The shaft sleeve 25 is a substantially elongated cuboid, which includes a first receiving room 251 defined in the shaft sleeve 25 for receiving the screw rod 24, and a first opening 253 defined on a side of the shaft sleeve 25 to allow the first adjusting module 23 to pass through. The screw rod 24 and a part of the first adjusting module 23 are received in the first receiving room 251. The two ends of the shaft sleeve 25 are fixed to the base 21 and the cover 22, respectively.

Figure 4:
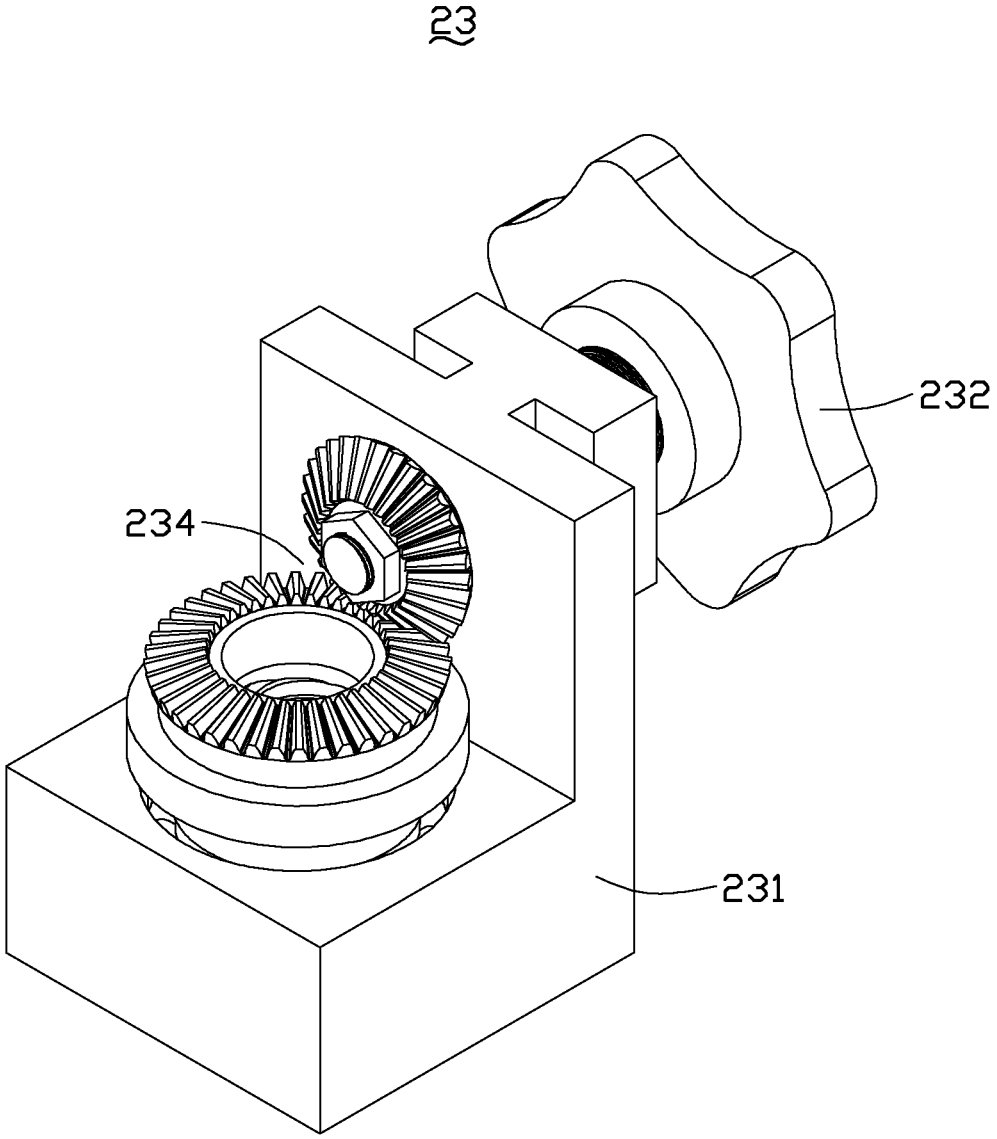
FIG. 4 is an enlarged, isometric view of the first adjusting module of the first axis mechanism of FIG. 2.
Figure 5:
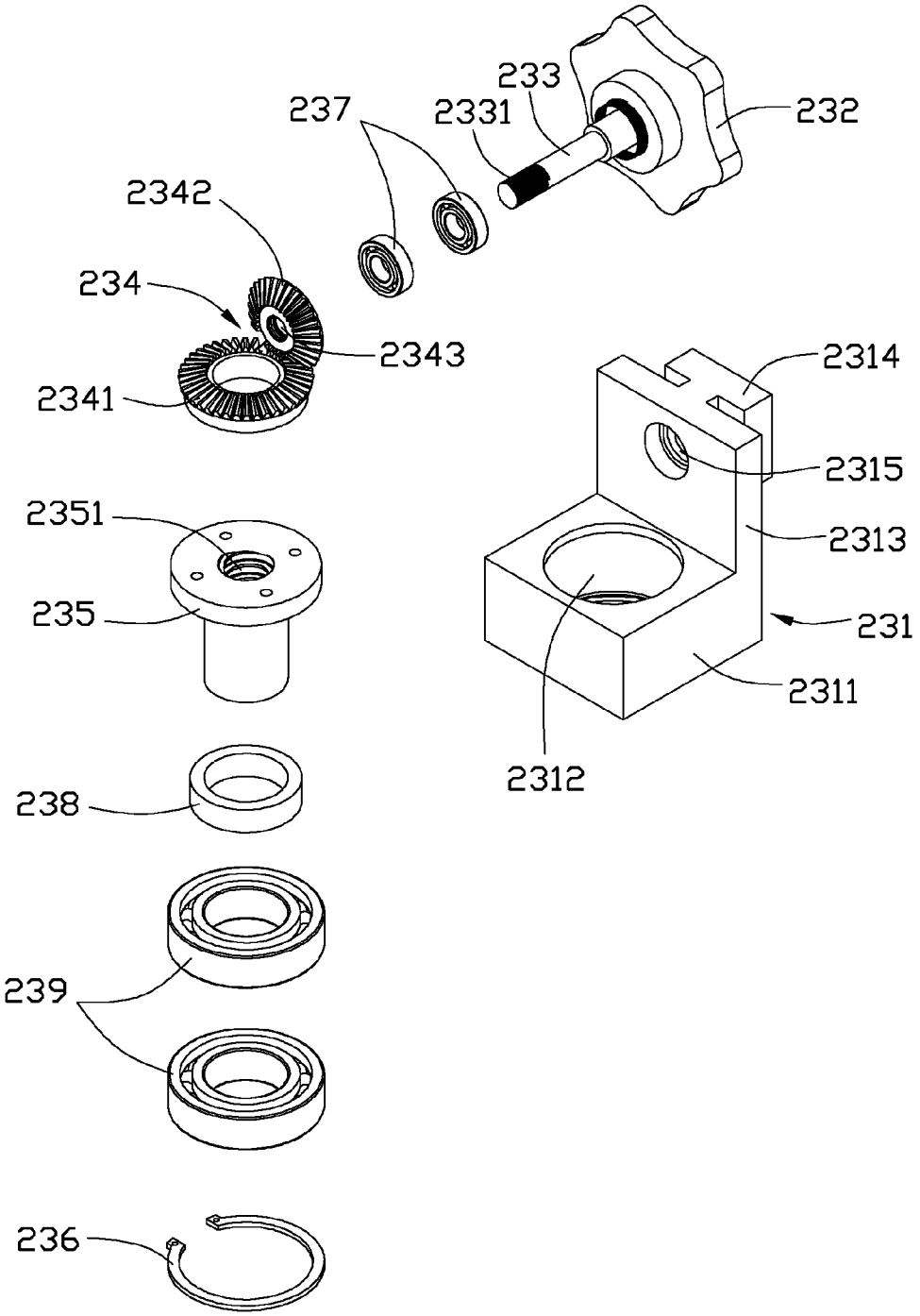
FIG. 5 is an exploded, isometric view of the first adjusting module of FIG. 4.

Referring to FIGS. 4 and 5, the first adjusting module 23 includes a first sliding block 231, a first knob 232, a first driving shaft 233, a gear pair 234, a screw nut 235, a clamping ring 236, two first bearings 237, a washer 238, and two second bearings 239.

The first sliding block 231 is slidably engaged with the screw rod 24. The first sliding block 231 is substantially L-shaped, and includes a first supporting portion 2311, a second supporting portion 2313 vertically positioned on the first supporting portion 2311, and a T-shaped block 2314. The T-shaped block 2314 is positioned on a side surface of the second supporting portion 2313 opposite to the first supporting portion 2311. The first supporting portion 2311 defines a first through hole 2312 in a surface of the first supporting portion 2311 forming the second supporting portion 2313. The second supporting portion 2313 defines a second through hole 2315 passing through the T-shaped block 2314. The first supporting portion 2311 and the second supporting portion 2313 are received in the first receiving room 251 of the shaft sleeve 25, and the T-shaped block 2314 passes through the first opening 253 of the shaft sleeve 25.

One end of the first driving shaft 233 is fixed to the first knob 232, and the other end of the first driving shaft 233 has a plurality of screw threads 2331 to engage with the gear pair 234. The two first bearings 237 are positioned in the two ends of the second through hole 2315, and the first driving shaft 233 passes through the two first bearings 237, and is rotatably positioned in the second through hole 2315.

The gear pair 234 includes a first bevel gear 2341 and a second bevel gear 2342 meshing at right angles with the first bevel gear 2341. The second bevel gear 2342 defines an axis hole 2343 threaded to accept the screw threads 2331 of the first driving shaft 233. The first bevel gear 2341 is sleeved on the screw rod 24.

The screw nut 235 is sleeved on the screw rod 24, and defines a screw hole 2351 in a center thereof, and is threaded to accept the screw rod 24. The first bevel gear 2341 is fixed on the upper surface of the screw nut 235. The neck of the screw nut 235 passes through the washer 238, the second bearings 239, and the clamping ring 236 in that order, and is then rotatably positioned in the first through hole 2312.

The first driving shaft 233 is driven to rotate upon the rotation of the first knob 232. At the same time, the first driving shaft 233 drives the second bevel gear 2342 to rotate, the second bevel gear 2342 drives the first bevel gear 2341 to rotate, and thereby the screw nut 235 is rotated around the screw rod 24, thereby causing the first adjusting module 23 to move along the screw rod 24.

Figure 6:
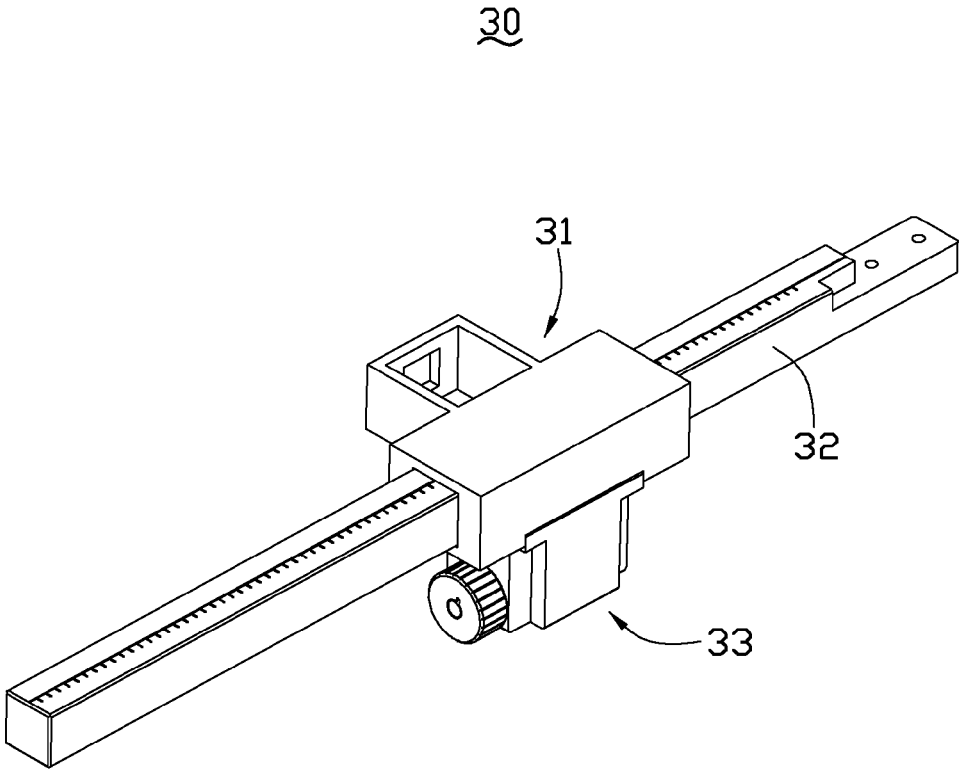
FIG. 6 is an isometric view of the second axis mechanism of the spray gun adjusting device of FIG. 1.
Figure 7:
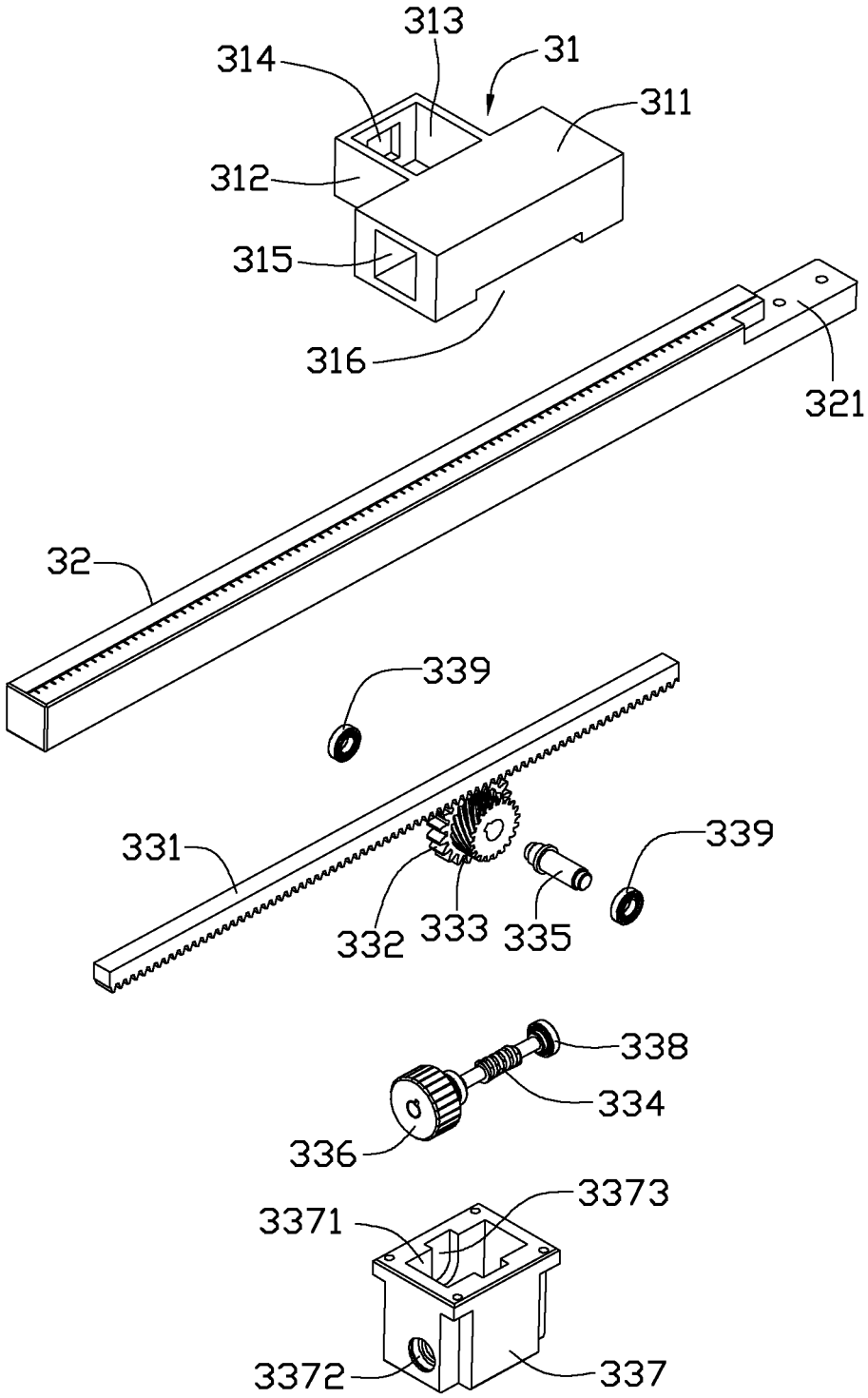
FIG. 7 is an exploded, isometric view of the second axis mechanism of FIG. 6.

Referring to FIGS. 6 and 7, the second axis mechanism 30 includes a second sliding block 31, a sliding rod 32, and a second adjusting module 33.

The second sliding block 31 includes a main body 311 and a connecting portion 312 extending outside from the side surface of the main body 311. The connecting portion 312 defines a first connecting hole 313 to match the cross sectional area of the shaft sleeve 25. The side of the connecting portion 312 opposite to the main body 311 defines a first square groove 314 to match the end of the T-shaped block 2314 away from the second supporting portion 2313. A second connecting hole 315 is defined in the main body 311 and passing through two sides of the main body 311 adjacent to the connecting portion 312, to correspond to the cross sectional area of the sliding rod 32. The bottom of the main body 311 defines a second square groove 316 to receive the second adjusting module 33.

The second sliding block 31 is sleeved on the shaft sleeve 25 via the first connecting hole 313, and the end of the T-shaped block 2314 away from the second supporting portion 2313 is positioned in the first square groove 314. Therefore, the second axis mechanism 30 can move in the first direction along with the first adjusting module 23 also moving in the first direction.

The sliding rod 32 passes through the second connecting hole 315, and the sliding rod 32 can move in the second direction relative to the second sliding block 31. The sliding rod 32 defines a receiving groove (not shown) on the bottom thereof for receiving a part of the second adjusting module 33. The sliding rod 32 includes a stepped extending end 321 for fixing the third axis mechanism 40.

The second adjusting module 33 includes a gear rack 331, a gear 332 meshing with the gear rack 331, a first worm gear 333 fixedly connected to the gear 332, a first worm rod 334 meshing with the first worm gear 333, a second driving shaft 335, a second knob 336, a first gear box 337, two third bearings 338, and two fourth bearings 339. The gear rack 331 is received in the receiving groove of the sliding rod 32. The second knob 336 is fixed to one end of the first worm rod 334. The gear 332 and the first worm gear 333 are sleeved on the second driving shaft 335.

The first gear box 337 is a square hollow box defining an opening 3371 in a surface of the first gear box 337 facing the second sliding block 31. The two opposite sides of the first gear box 337 define two mounting holes 3372. The two third bearings 338 are each positioned in one mounting hole 3372, and the first worm rod 334 passes through the two third bearings 338 and is rotatably positioned in the mounting holes 3372. The inner surfaces of the other two opposite sides of the first gear box 337 each defines a mounting groove 3373. The fourth bearings 339 are positioned in the mounting grooves 3373, and the first worm gear 333 passes through the two fourth bearings 339 and is rotatably positioned in the mounting grooves 3373.

The first worm rod 334 is rotated by the second knob 336. At the same time, the first worm rod 334 rotates the first worm gear 333, the first worm gear 333 rotates the gear 332, and the gear rack 331 and the sliding rod 32 thereby move in the second direction.

Figure 8:
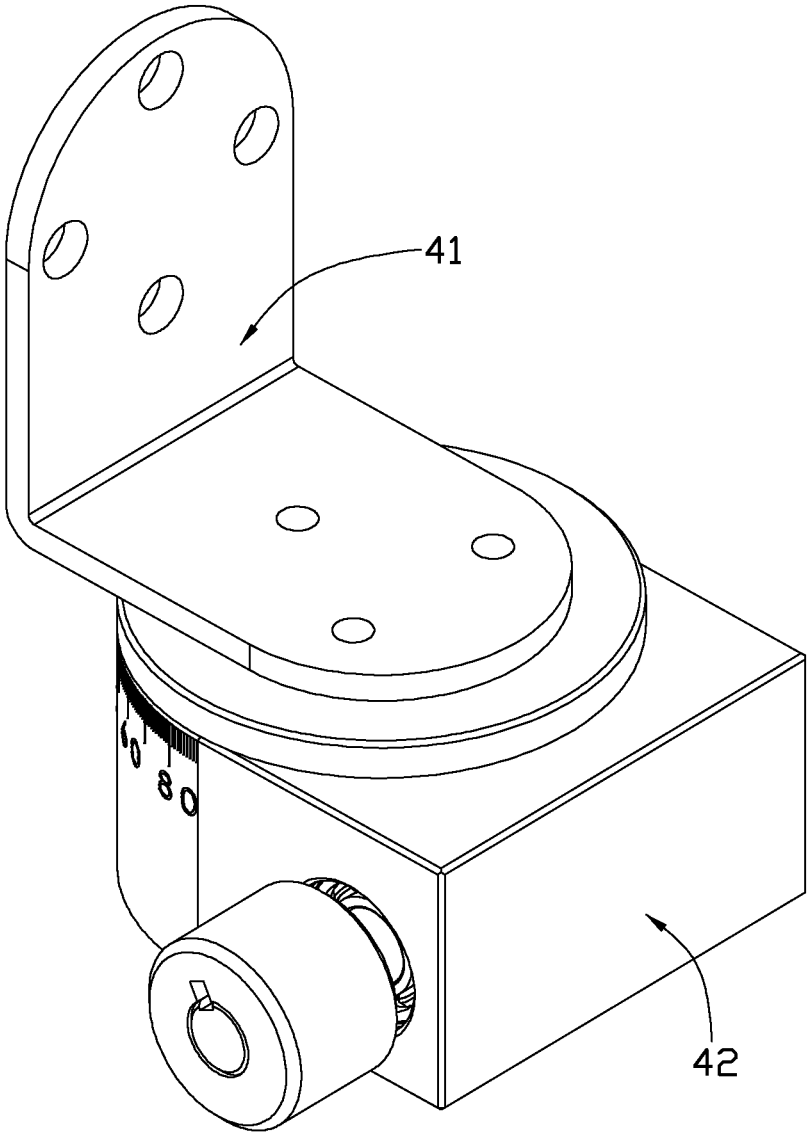
FIG. 8 is an isometric view of the third axis mechanism of the spray gun adjusting device of FIG. 1.
Figure 9:
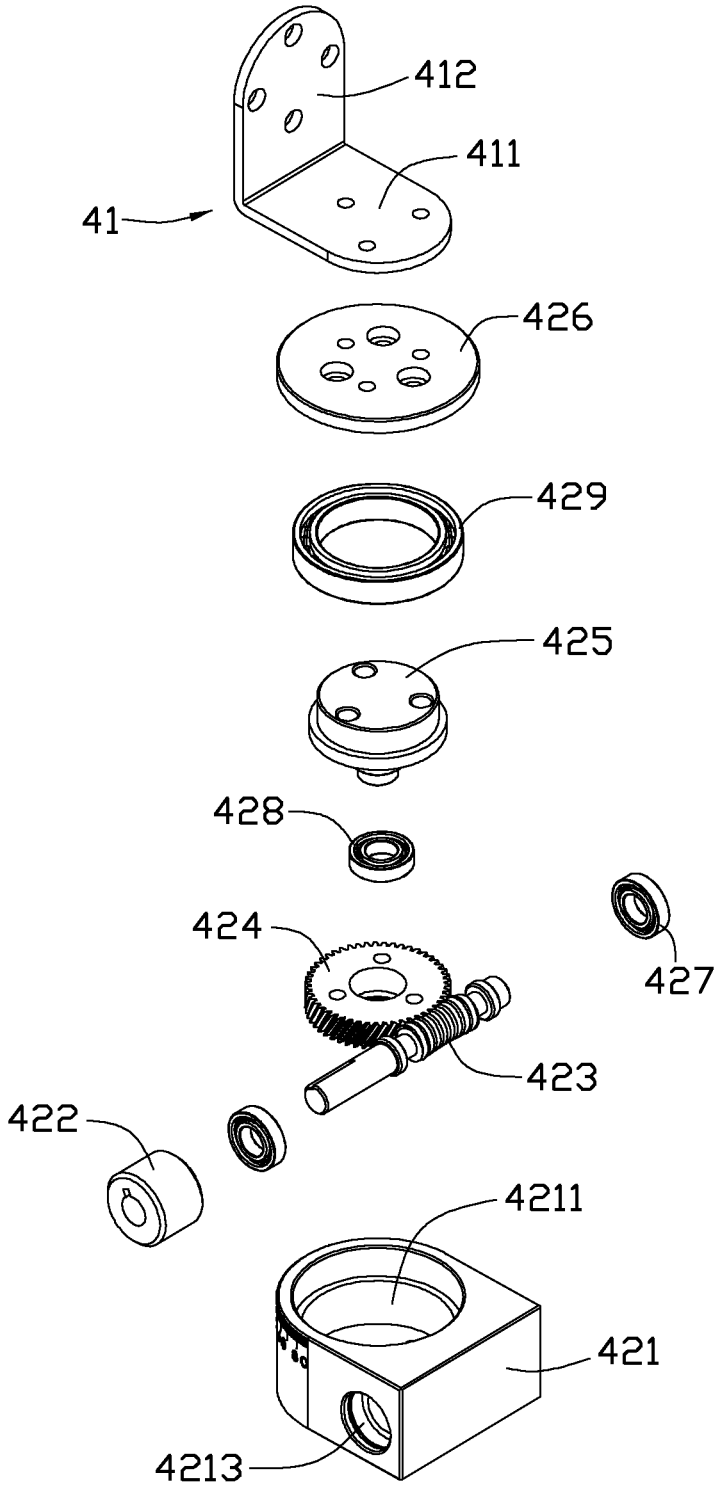
FIG. 9 is an exploded, isometric view of the third axis mechanism of FIG. 8.

Referring to FIGS. 8 and 9, the third axis mechanism 40 includes a connecting plate 41 and a third adjusting module 42.

The connecting plate 41 includes a horizontal first fixing portion 411 and a second fixing portion 412 formed vertically from the first fixing portion 411.

The third adjusting module 42 includes a second gear box 421, a third knob 422, a second worm rod 423, a second worm gear 424 meshing with the second worm rod 423, a third driving shaft 425, a mounting plate 426, two fifth bearings 427, a sixth bearing 428, and a seventh bearing 429. The third knob 422 is fixed to one end of the second worm rod 423. The second worm gear 424 is fixedly sleeved on the third driving shaft 425. The mounting plate 426 is fixed to the upper end of the third driving shaft 425, and the first fixing portion 411 of the connecting plate 41 is fixed to the mounting plate 426.

The second gear box 421 is fixed to the extending end 321 of the sliding rod 32. The second gear box 421 is a box with one semicircular side surface and three flat rectangular side surfaces. The upper surface of the second gear box 421 defines a stepped receiving hole 4211, and the bottom surface of the second gear box 421 defines an installation hole (not shown). The sixth bearing 428 is positioned in the installation hole, and the seventh bearing 429 is positioned in the end of the receiving hole 4211 away from the installation hole. The third driving shaft 425 passes through the sixth bearing 428 and the seventh bearing 429, and is rotatably positioned in the receiving hole 4211 and the installation hole. The two rectangular side surfaces adjacent to the semicircular side surface of the second gear box 421 define two assembling holes 4213. The fifth bearings 427 are positioned in the assembling holes 4213, and the second worm rod 423 passes through the two fifth bearings 427 and is rotatably positioned in the assembling holes 4213.

When the third knob 422 is being rotated, the second worm rod 423 follows, and drives the second worm gear 424 and the third driving shaft 425 to rotate, thereby rotating the connecting plate 41 around the first direction.

Figure 10:
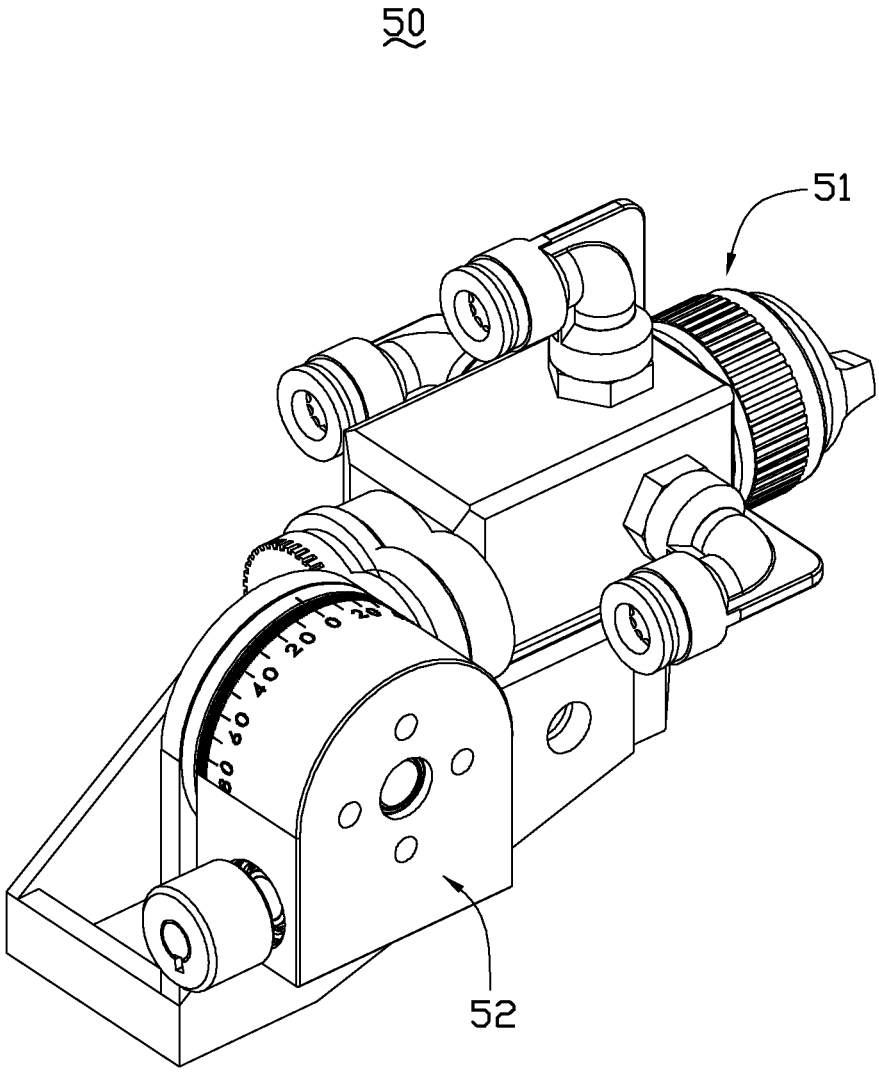
FIG. 10 is an isometric view of the fourth axis mechanism of the spray gun adjusting device of FIG. 1 with the spray guns being mounted.
Figure 11:
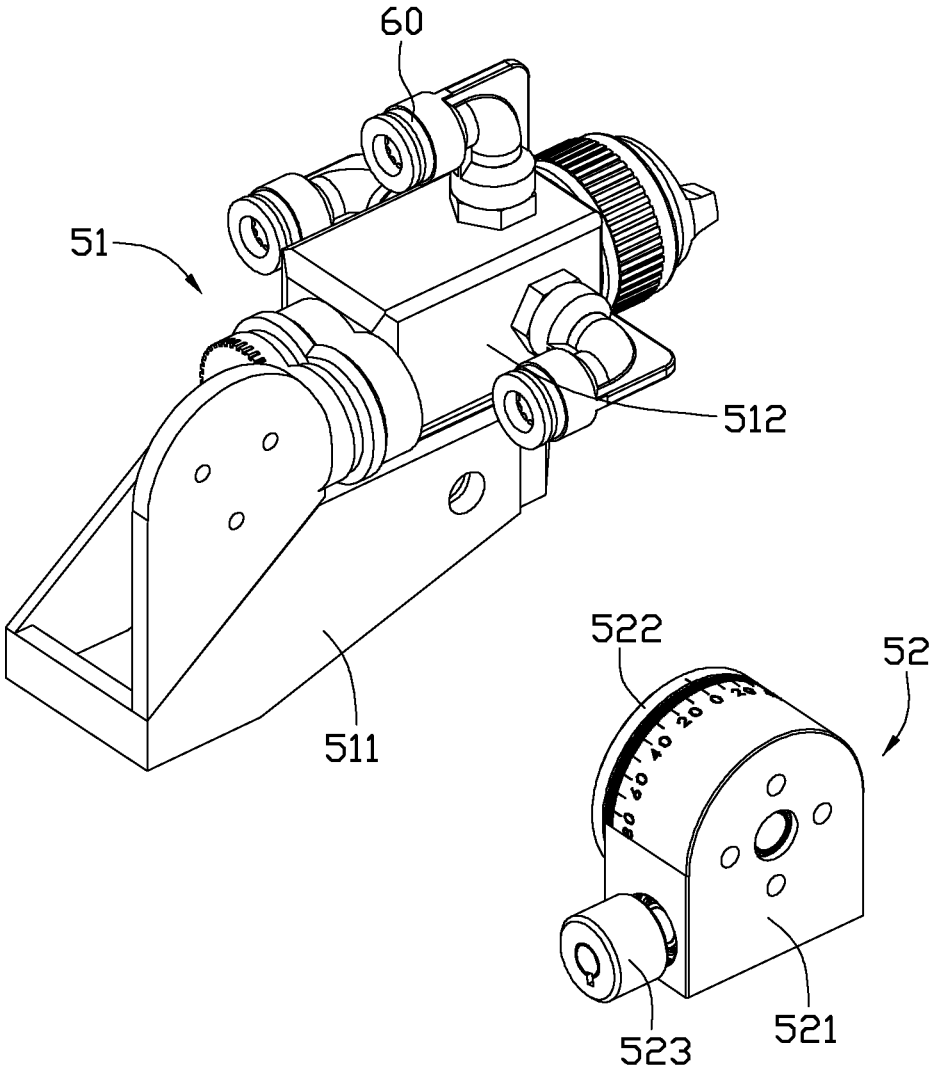
FIG. 11 is an exploded, isometric view of the fourth axis mechanism and the spray guns of FIG. 10.

Referring to FIGS. 10 and 11, the fourth axis mechanism 50 includes a spray gun fixing module 51 for mounting the spray guns 60, and a fourth adjusting module 52.

The spray gun fixing module 51 includes a fixing base 511 and a mounting base 512. The mounting base 512 is fixed on the fixing base 511, and the spray guns 60 are mounted on the mounting base 512.

The fourth adjusting module 52 is similar to the third adjusting module 42. The fourth adjusting module 52 includes a third gear box 521, a second mounting plate 522, a fourth knob 523, and a third worm rod (not shown), a third worm gear (not shown), and a fourth driving shaft (not shown), which are all received in the third gear box 521.

The third gear box 521 is fixed to the second fixing portion 412 of the connecting plate 41. The second mounting plate 522 is fixed to the side of the third gear box 521 opposite to the second fixing portion 412, and the fixing base 511 is fixed to the second mounting plate 522.

When the fourth knob 523 is rotated, the spray gun fixing module 51 rotates around the third direction.

In the illustrated embodiment, the outer surfaces of the shaft sleeve 25, the sliding rod 32, the second gear box 421, and the third gear box 521 have markings to increase the precision of the spray gun adjusting device, and for recording the corresponding adjustments.

It should be appreciated that the spray gun adjusting device 100 can include at least one first adjusting modules 23, at least one second axis mechanism 30 positioned on the at least one first adjusting modules 23, at least one third axis mechanism 40, and at least one fourth axis mechanism 50, together allowing achieving a multi-layer and multi-angle painting configuration.

The spray gun adjusting device 100 can drive the spray guns 60 to move in the first and second directions, and to rotate around the first and third directions by means of the first, second, third, and fourth axis mechanisms 20, 30, 40, and 50, thereby achieving any required position and angle of the spray guns 60. The functionalities of the first axis mechanism 20 (driven by the gear pair 234, the screw nut 235, and the screw rod 24), the second axis mechanism 30 (driven by the first worm gear 333, the first worm rod 334, the gear 332, and the gear rack 331), the third axis mechanism 40 (driven by the second worm rod 423 and the second worm gear 424), and the fourth axis mechanism 50 (driven by the third worm rod and the third worm gear), give the spray gun adjusting device 100 a higher adjustment accuracy and a self-locking capability, and ensure stability and smoothness in painting. The spray gun adjusting device 100 may be adjusted by turning the first, second, and third knobs (232, 336, and 422), and the fourth knob 523, and the spray gun adjusting device 100 may be adjusted during painting, thereby allowing continuous painting during adjustments, which increases productivity. Furthermore, the spray gun adjusting device 100 is mechanically driven, and need not be driven by local motors or motors in the joints of the device, thereby the spray gun adjusting device 100 is not a fire risk or liable to explode in the painting area.

It is believed that the present embodiments and their advantages will be understood from the foregoing description, and it will be apparent that various changes may be made thereto without departing from the spirit and scope of the disclosure or sacrificing all of its material advantages.

What is claimed is:

1. A spray gun adjusting device utilized to adjust a painting position of a spray gun, comprising:

a first axis mechanism; and a second axis mechanism slidably positioned on the first axis mechanism;

wherein the first axis mechanism comprises a screw rod extending along a first direction, a first sliding block slidably sleeved on the screw rod, a screw nut sleeved on and threaded to accept the screw rod, a first bevel gear fixed to the screw nut, a second bevel gear meshing with the first bevel gear, and a first driving shaft fixedly connected to the second bevel gear, and the screw nut and the first driving shaft are rotatably positioned on the first sliding block; and the second axis mechanism comprises a sliding rod extending along a second direction, a second sliding block slidably sleeved on the sliding rod, a gear rack fixed to the sliding rod, a gear meshing with the gear rack, and a second driving shaft fixed to the gear, and the second sliding block is fixed to the first sliding block of the first axis mechanism.

2. The spray gun adjusting device of claim 1, wherein the first sliding block comprises a first supporting portion, a second supporting portion vertically positioned on the first supporting portion, and a T-shaped block positioned on the second supporting portion opposite to the first supporting portion, the first supporting portion defines a first through hole to allow the screw nut to position, and the second supporting portion defines a second through hole passing through the T-shaped block, to allow the first driving shaft to position.

3. The spray gun adjusting device of claim 2, wherein the first axis mechanism further comprises two first bearings and two second bearings, the two first bearings are positioned in the second through hole, the two second bearings are positioned in the first through hole, the first driving shaft passes through the two first bearings, and the screw nut passes through the two second bearings.

4. The spray gun adjusting device of claim 2, wherein the first axis mechanism further comprises a shaft sleeve, the shaft sleeve defines a first receiving room for receiving the screw rod, and a first opening defined on a side of the shaft sleeve to allow the first sliding block to pass through.

5. The spray gun adjusting device of claim 4, wherein an outer surface of the shaft sleeve has a plurality of markings.

6. The spray gun adjusting device of claim 4, wherein the second sliding block comprises a main body and a connecting portion extending a side of the main body, the connecting portion defines a first connecting hole to allow the shaft sleeve to pass through, and two sides of the main body adjacent to the connecting portion define a second connecting hole, to allow the sliding rod to pass through.

7. The spray gun adjusting device of claim 6, wherein a side of the connecting portion opposite to the main body defines a first square groove, an end of the T-shaped block away from the second supporting portion is positioned in the first square groove.

8. The spray gun adjusting device of claim 1, wherein the first axis mechanism further comprises a first knob fixed to an end of the first driving shaft opposite to the second bevel gear.

9. The spray gun adjusting device of claim 8, wherein the second axis mechanism further comprises a first worm rod and a first worm gear meshing with the first worm rod, the first worm gear is fixed to the gear, and the first worm gear and the gear are fixedly sleeved on the second driving shaft.

10. The spray gun adjusting device of claim 9, wherein the second axis mechanism further comprise a second knob, and the second knob is fixed to an end of the first worm rod.

11. The spray gun adjusting device of claim 9, wherein the second axis mechanism further comprises a first gear box, the first gear box is a square hollow box with an upper surface thereof defining an opening, and two opposite sides of the first gear box define two mounting holes for mounting the first worm rod, and an inner surfaces of the other two opposite sides of the first gear box define two mounting grooves for mounting the second driving shaft.

12. The spray gun adjusting device of claim 11, further comprising a third axis mechanism rotatably fixed to the second axis mechanism, and the third axis mechanism comprises a second worm rod, a second worm gear meshing with the second worm rod, and a third driving shaft, and the second worm gear is fixedly sleeved on the third driving shaft.

13. The spray gun adjusting device of claim 12, wherein the third axis mechanism further comprises a second gear box fixed to the sliding rod of the second axis mechanism, the second worm rod and the third driving shaft are rotatably positioned on the second gear box.

14. The spray gun adjusting device of claim 13, further comprising a fourth axis mechanism rotatably fixed to the third axis mechanism, and the fourth axis mechanism comprises a third worm rod, a third worm gear meshing with the third worm rod, a fourth driving shaft, and the third worm gear is fixedly sleeved on the fourth driving shaft.

15. The spray gun adjusting device of claim 14, wherein the fourth axis mechanism further comprises a spray gun fixing module for mounting the spray gun and a third gear box fixed to the spray gun fixing module, and the third worm rod and the fourth driving shaft are rotatably positioned on the third gear box.

16. The spray gun adjusting device of claim 15, wherein the third axis mechanism further comprises a connecting plate, the connecting plate comprises a horizontal first fixing portion and a second fixing portion rising vertically from the first fixing portion, and the first fixing portion is fixed to the second gear box, and the second fixing portion is fixed to the third gear box.

17. The spray gun adjusting device of claim 16, wherein outer surfaces of the sliding rod, the second gear box, and the third gear box have a plurality of markings.

18. A spray gun adjusting device utilized to adjust a painting position of a spray gun, comprising:

a first axis mechanism comprising:

a screw rod extending along a first direction, a first sliding block, a screw nut sleeved on and threaded to the screw rod, a first bevel gear fixed to the screw nut, a second bevel gear meshing with the first bevel gear, and a first driving shaft fixedly connected to the second bevel gear, the screw nut and the first driving shaft being rotatably positioned on the first sliding block;

a second axis mechanism slidably positioned on the first axis mechanism;

a third axis mechanism rotatably fixed to the second axis mechanism; and a fourth axis mechanism rotatably fixed to the third axis mechanism, and the spray gun positioned on the fourth axis mechanism;

wherein the first axis mechanism drives the spray gun in a first direction, the second axis mechanism drives the spray gun in a second direction, the third axis mechanism drives the spray gun to rotate around the first direction, and the fourth axis mechanism drives the spray gun to rotate around the third direction.

19. The spray gun adjusting device of claim 18, wherein the second axis mechanism comprises a sliding rod extending along the second direction, a second sliding block slidably sleeved on the sliding rod, a gear rack fixed to the sliding rod, a gear meshing with the gear rack, and a second driving shaft fixed to the gear, and the second sliding block is fixed to the first sliding block of the first axis mechanism.

* * * * *